US005465779A

United States Patent [19]

Rozon

[11] Patent Number: 5,465,779

[45] Date of Patent: Nov. 14, 1995

[54] INTEGRATED CORD LOOP DRIVE MEANS AND HOUSING FOR WINDOW COVERING

[76] Inventor: David Rozon, 538 Chartrand Street, Russell, Ontario, Canada, K4R 1G1

[21] Appl. No.: 278,834

[22] Filed: Jul. 22, 1994

[51] Int. Cl.[6] ..... E06B 9/30

[52] U.S. Cl. ..... 160;168.1; 160/176.1

[58] Field of Search ..... 160/168.1 V, 176.1 V, 160/173 V, 178.1 V, 344, 345, 320, 107; 188/65.1, 65.2, 65.3, 65.4, 65.5; 24/122.6

[56] References Cited

U.S. PATENT DOCUMENTS

| | | | |
|---|---|---|---|
| 3,022,819 | 2/1962 | Lampret | 160/345 |
| 3,478,807 | 11/1969 | Gertzberg | 160/344 |
| 3,633,646 | 1/1972 | Zilver | 160/168.1 R |
| 4,550,759 | 11/1985 | Archer | 160/176.1 P |
| 4,813,469 | 3/1989 | Scott | 160/900 X |
| 4,936,369 | 6/1990 | Darner | 160/168.1 V |
| 5,125,447 | 6/1992 | Suggs | 160/344 |
| 5,167,268 | 12/1992 | Mao | 160/178.2 R |

*Primary Examiner*—David M. Purol

*Attorney, Agent, or Firm*—Adrian Zahl

[57] ABSTRACT

A housing to enclose the exposed portion of the cord loop of a window blind or other window covering includes an integral drive arrangement to cycle a cord loop through the headrail of the blind, in order to open or close the blind. The cord loop is retained within the housing by a cord guide, such as a pulley, mounted at the lower end of the housing. A cord grip member displaceable between upper and lower ends of the housing permits the user to drive the cord loop. The cord grip member is provided with first and second clamps within the housing and first and second actuators external to the housing, each clamp being linked to a respective actuator through an elongate slot within the housing. The clamps may be actuated to releasably grip a first or second strand of the cord, respectively, to drive the cord loop in one direction or the other when the cord grip member is drawn downwardly along the housing. A tilt rod drive arrangement may be incorporated into the device to allow a user to rotate the tilt rod of a vertical blind with the device. The tilt rod drive arrangement includes a shaft rotatably disposed within the housing, linked to the tilt rod of the blind headrail.

17 Claims, 3 Drawing Sheets

INTEGRATED CORD LOOP DRIVE MEANS AND HOUSING FOR WINDOW COVERING

FIELD OF THE INVENTION

The present invention relates to a means to house the cord loop of a vertical blind or other window covering and to cycle the cord loop to open or close the blind. The device is an alternative to a freely dangling cord loop and may also include an integrated tilt rod drive means to allow a user to rotate the vanes of a vertical blind.

BACKGROUND OF THE INVENTION

A window blind or curtain is generally opened or closed by the use of a cord or chain, which may dangle within reach of young children and present a safety hazard. As well, a freely dangling cord can become tangled, and is seen by some as unsightly and cumbersome to operate. Various solutions have been proposed to address this problem. In particular, the present inventor has been granted U.S. Pat. No. 5,279,473, and has filed application no. 08/022,891, relating to a take-up reel to retract the cord of a window blind, and in particular, the cord loop of a vertical blind. As well, the present inventor has filed application no. [application number not yet assigned], relating to a wand for the taking up of the cord of a horizontal slat-type venetian blind.

The cords of vertical blinds and certain roller blinds, curtains and other window coverings are particularly difficult to retract, since these typically comprise a cord loop that must be cycled in one direction or the other to open or close the covering. There exist a variety of window coverings that are operated by a cord loop; it will be understood that the term "blind" as used herein refers generally to any type of window covering that is operated by the cycling of a cord loop through a headrail. In the case of a vertical blind, the cycling of the cord loop displaces the vanes laterally to open or close the blind. Typically, the cord loop extends through the headrail of the blind, and is linked to a lead vane carrier or carriers. An end of the loop dangles from the head rail to permit user actuation of the blind. For reference purposes, this dangling portion of the loop will be arbitrarily described as comprised of first and second strands, with the first and second strands comprising the two vertical strands of the same cord loop. A downward pull of the first strand draws the blind open, and a downward pull of the second strand draws it closed. Similarly, other types of blinds may be provided with a cord loop that serves a similar function.

Difficulties are encountered if it is desired to retract a portion of the loop to take it out of reach of children. An ordinary take-up reel engaged %o the cord would prevent it from freely cycling in both directions. As well, a take-up reel, even if adapted to allow the cord to cycle freely, suffers the drawback of requiring the user to operate the reel to draw up the cord after each use. If this step is not taken when a young child is present, tragedy may result.

It is desirable to provide a device that partly or fully encloses the cord loop at all times, but still permits a user to drive the cord loop. The use of an enclosure avoids the use of a freely dangling cord loop or the active step of retracting the cord after each use.

As well, for purposes of aesthetics and convenience, it is desirable to integrate the lateral vane opening means of a vertical blind with a means for rotating the vanes of the blind. Typically, a vertical blind is provided with a rotatable "tilt rod" journalled within the interior of the headrail, linked to an array of vane carriers slideably disposed within the headrail. The vane carriers are adapted to translate rotational movement of the tilt rod into rotation of the vanes. One end of the tilt rod terminates in a sprocket, and the user rotates the tilt rod by cycling a chain depending from the sprocket. This vane-rotation chain represents an additional hazard and inconvenience, and may be replaced by a tilt rod drive means, comprising a rotatable shaft, linked to the tilt rod by means of a universal joint or the like and a gearing system, wherein rotation of the control rod is translated into rotation of the tilt rod. The control rod may be integrated with blind-opening means to provide a single unit to control both rotation and lateral displacement of the vanes.

OBJECTS OF THE INVENTION

It is an object of the present invention to provide a cord loop drive means particularly adapted for use with vertical blinds, but adaptable as well for use with other types of blinds that are operated by a cord loop, that eliminates or minimizes the risk posed by an exposed dangling cord loop. It is a further object to provide an integrated cord loop drive means and tilt rod drive means that is convenient to use, relatively simple to manufacture, and that provides an aesthetically pleasing alternative to a freely dangling cord. It is a further object to provide an integrated vane displacement and rotation means for use with a vertical blind, and a vertical blind that incorporates such means.

SUMMARY OF THE INVENTION

The present invention is an integrated drive means and enclosure for the cord loop of a window covering, and in particular, for a vertical blind, with the cord loop being comprised or first and second vertical strands depending from the headrail of the covering. The drive means and enclosure comprises in its broadest form:

a) an elongate wand-shaped slotted housing for enclosure of the first and second strands of the cord loop;

b) a cord guide, such as a pulley, mounted at the lower end of the housing to retain the lower end of the cord loop within the lower end of the housing and to permit the cord loop to cycle through the housing; and c) a cord grip member displaceable between upper and lower ends of the housing. The cord grip member is provided with first and second clamps disposed within the housing and first and second actuators external to the housing, each clamp being linked to a respective actuator through an elongate slot within the housing. The first clamp is adapted to releasably grip the first strand when actuated by the first actuator and the second clamp is adapted to releasably grip the second strand when actuated by the second actuator. The cord grip member is adapted to drive the cord loop through the wand in a first or second direction when the first or second clamp is actuated, respectively, and the cord grip member is drawn downwardly along the housing.

In a preferred embodiment, the cord grip member comprises a generally tubular body that encircles the housing, linked to the clamps by means of an arm extending through a slot within the housing. The clamps are each engaged to a corresponding hand-depressible actuator on the tubular body.

A tilt rod drive means may be incorporated into the device, to allow a user to rotate the tilt rod of a vertical blind with the device. The tilt rod drive means comprises a shaft journalled within the housing, rotatably linked to the tilt rod of a vertical blind. Hand-operable rotation means, such as a handle, are provided to allow the user to rotate the shaft, resulting in rotation of the vanes of the blind.

The invention further comprises a window covering that incorporates the integrated cord loop drive means and enclosure described above, and a vertical blind incorporating the device, including the integrated tilt rod drive means.

The term "cord" as used herein refers as well to chain, tape, and other elongate flexible strands that serve the function of a cord. As well, the directional references used herein refer to the device positioned vertically, in the position it would assume when Suspended from the horizontally-oriented headrail of a blind.

DETAILED DESCRIPTION OF THE PREFERRED EMBODIMENT

Figure 1:
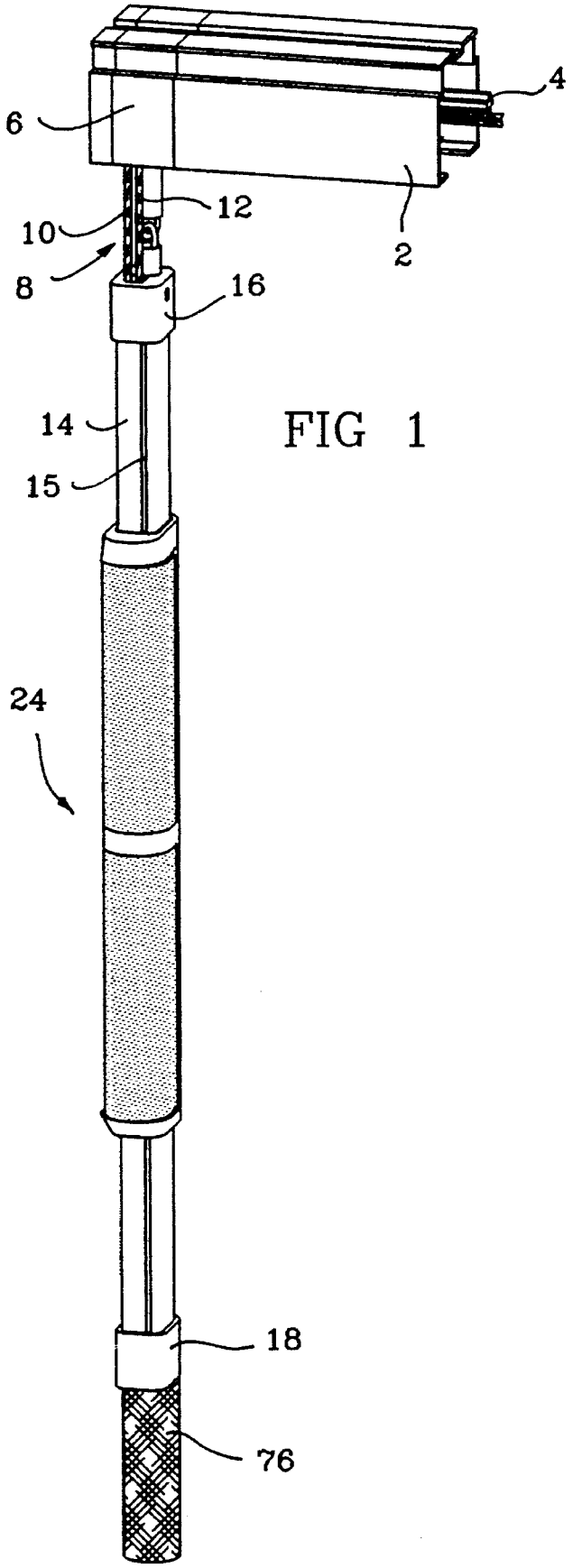
FIG. 1 as a perspective view of the device installed on the headrail of a vertical blind.
Figure 2:
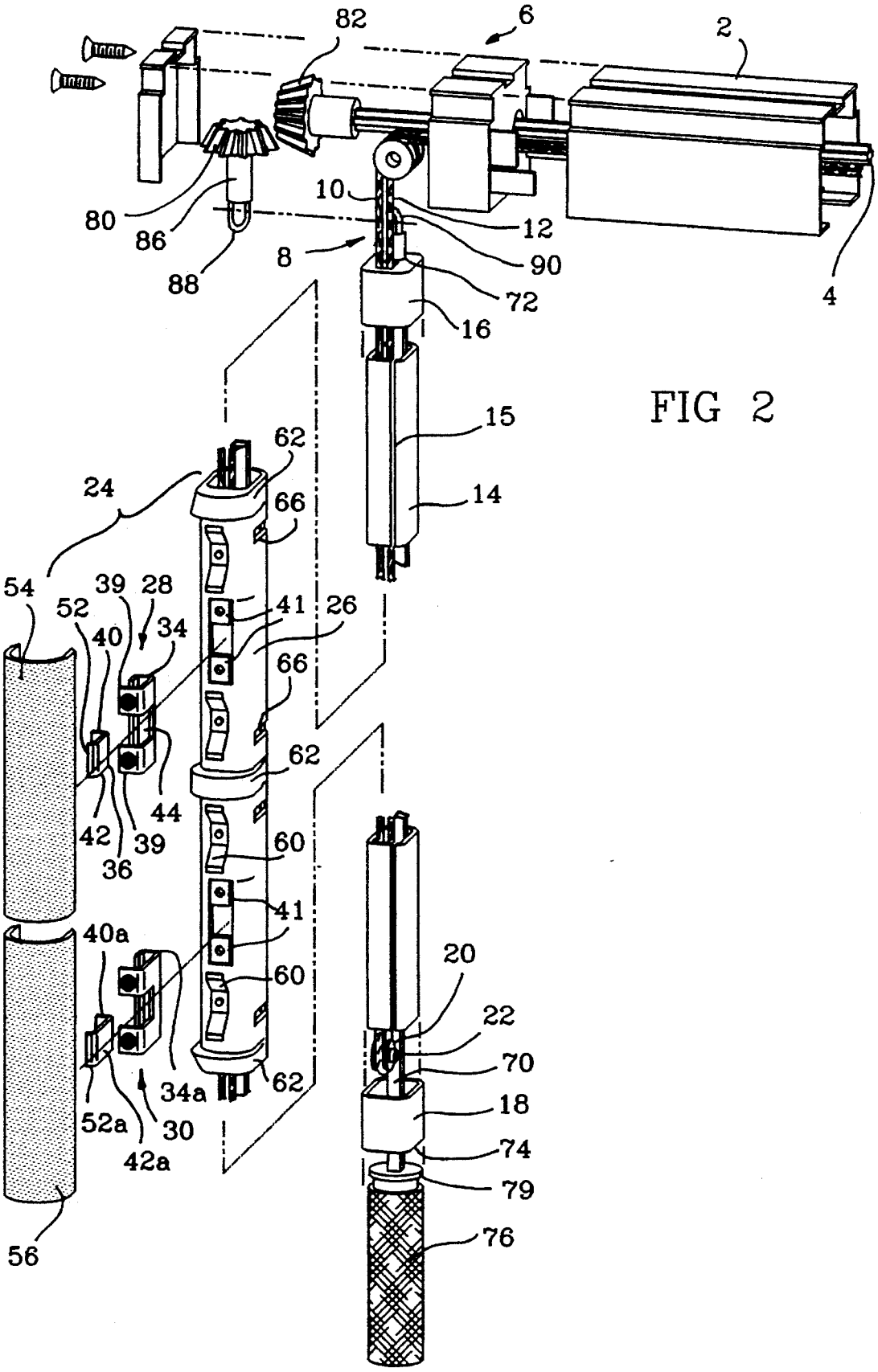
FIG. 2 is a perspective exploded view of the device installed on the headrail.

Referring to FIGS. 1 and 2, the cord loop drive means of the preferred embodiment is incorporated within a wand that may be suspended from a headrail 2 of a vertical blind. The headrail 2 illustrated here is typical of vertical blinds, and houses a tilt rod 4 journalled within its interior. An array of vane carriers, not shown, are slideably disposed within the housing. Each vane carrier engages a corresponding vane, and is in turn linked to the tilt rod by a gearing system whereby rotation of the tilt rod effects rotation of the vane, to control the amount of light passing through the blind. The end of the headrail terminates in an end cap 6 that houses a gearing arrangement, to translate rotation of a tilt rod drive means into rotation of the tilt rod. The means by which rotation of the tilt rod drive means is effected will be described below. The headrail 2 also houses a cord loop 8 linked to the lead vane carrier or carriers (depending on whether the blind is a center-opening or side-opening type). As the cord loop is drawn through the headrail, the lead carriers are drawn laterally along the headrail in one direction or the other to open or close the blind. The cord loop depends from the headrail at the end cap 6, and the depending portion is comprised of first and second vertical strands 10 and 12, respectively. The first strand draws the vanes open when pulled downwardly, and the second strand draws them together when pulled downwardly. Of course, when one strand is pulled downwardly, the other strand travels upwardly.

The control unit is provided with an elongate tubular housing 14 having an axial slot 15 extending generally the length thereof. The housing, seen in cross section, resembles a truncated oval and encases most of the exposed portion of the cord loop. The upper and lower ends of the housing are capped by upper and lower caps 16 and 18. The cord loop 8 extends the length of the housing 14, and is engaged at its lower end to a cord guide, comprising a pulley 20 within the lower end of the housing that retains the cord in position within the housing and allows the cord to be freely cycled through the housing. The pulley is journalled about an axle 22 that transverses the lower cap 18. It will be understood that the pulley may be replaced with any member that serves a similar function of slideably retaining the cord loop within the housing, for example, a short shaft or the like.

A cord grip member 24 is slideably engaged to the housing and displaceable between upper and lower ends of the housing. The cord grip member permits the user to advance the cord in one direction or the other by selectively gripping the first or second strand, and permitting the user to draw the gripped strand downwardly within the housing. The non-gripped strand is free to slide simultaneously upwardly through the housing. The cord grip member is prevented from disengaging from the housing by the caps 16 and 18. The cord grip member comprises body and clamp portions, with the body portion including a generally tubular body 26 encircling the housing, and the clamp portion comprising upper and lower clamp members 28 and 30, releasably engageable with the first and second cord strands, respectively. The clamp members are independent of each other, and each may be separately actuated to grip its corresponding strand.

Figure 5:
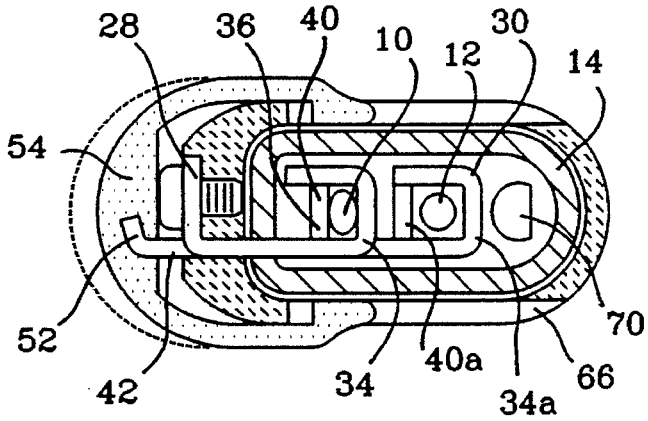
FIG. 5 is a sectional view showing a first clamp member gripping a first strand of the cord loop.

As seen in FIGS. 2, 4, 5 and 6, the upper clamp member 28 comprises opposing jaw members, with a first jaw member 34 being generally channel-shaped and the second jaw member 36 being disposed within the interior of the first jaw member. A wall 37 of the first jaw member extends through the slot 15 and terminates in paired tabs 39. The tabs 39 are mounted to mounts 41 within the body 26. The first strand 10 of the cord loop may selectively gripped between the two jaw members, as seen in FIG. 5. The second jaw member 36 is generally L-shaped and comprises a foot 40 and a leg 42 extending outwardly from the foot. The first jaw member has a slot 44 within its sidewall, to slideably retain the leg 42 of the second jaw member and thereby to retain the first and second jaw members together. The second strand 12 of the cord passes outside the upper clamp member 28 and is not gripped thereby.

Figure 6:
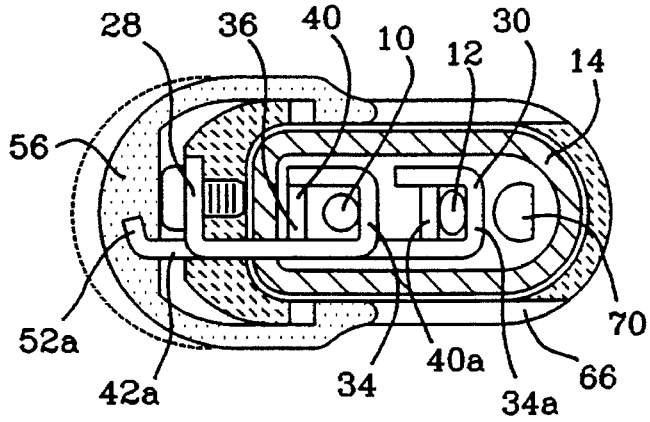
FIG. 6 is a sectional view showing a second clamp member gripping a second strand of the cord loop.

The lower clamp member 30 is similar to the first clamp member, but is adapted to releasably clamp the second strand 12 of the cord loop, as seen in FIG. 6. Since the second strand is positioned deeper within the housing 14 than the first strand, the lower clamp is provided with a broader first jaw member 34(*a*) and a longer leg 42(*a*), in order to grip the second strand when actuated by a corresponding actuator. The foot 40(*a*) of the second clamp member separates the first and second strands 10 and 12, with only the second strand passing between the two jaw members. Thus, the first strand is able to slide past the second clamp member at all times, without being gripped thereby.

In use, the upper clamp member is able only to grip the first strand, and the lower clamp member able only to grip the second strand, with the two clamp members being independently actuated. When the first strand 10 is gripped and drawn downwardly by the upper clamp, the second strand 12 freely slides upwardly past both the upper and lower clamps, and vice-versa.

Each of the clamp members is actuated by means of an actuator external to the housing. Each of the clamp members communicates with a corresponding actuator, by means of the legs 42 and 42(*a*) of each of the second jaw members extending through the slot 15 within the housing 14. Each of the legs 42 and 42(*a*) terminates in an inwardly-facing ledge 52 and 52(*a*), respectively, that engages an upper or lower actuator 54 or 56, respectively, of the cord grip member. The actuators each comprise a generally channel-shaped elongate member that partly wraps around the body 26 of the cord grip member 24. Depression of an actuator causes a corresponding clamp to grip a strand of the cord.

Paired springs 60 bias the actuator away from the body 26. Vertical movement of the actuators is prevented by shoulders 62 extending outwardly from the upper, middle, and lower regions of the body 26. The actuators are prevented from slipping outwardly off the body by means of tabs extending inwardly from the sidewalls of the actuators, snap-fitted within slots 66 within the body 26. The slots 66 permit radial movement of the actuators relative to the body.

In use, either the upper or lower actuator may be depressed, depending on whether it is desired to open or close the blind. The cord grip member is initially pushed to the top of the housing with both actuators released. If it is desired to open the blind, the upper actuator is depressed to grip the first strand, and the cord grip member, with the actuator depressed, is then drawn to the bottom of the housing, and the actuator released. The process is repeated until the blind is opened by the desired amount. To close the blind, the process is repeated with the lower actuator. Each cycle of the grip member draws the blind open or closed by an amount corresponding generally to the length of the housing, less the length of the cord grip member and the caps.

Figure 3:
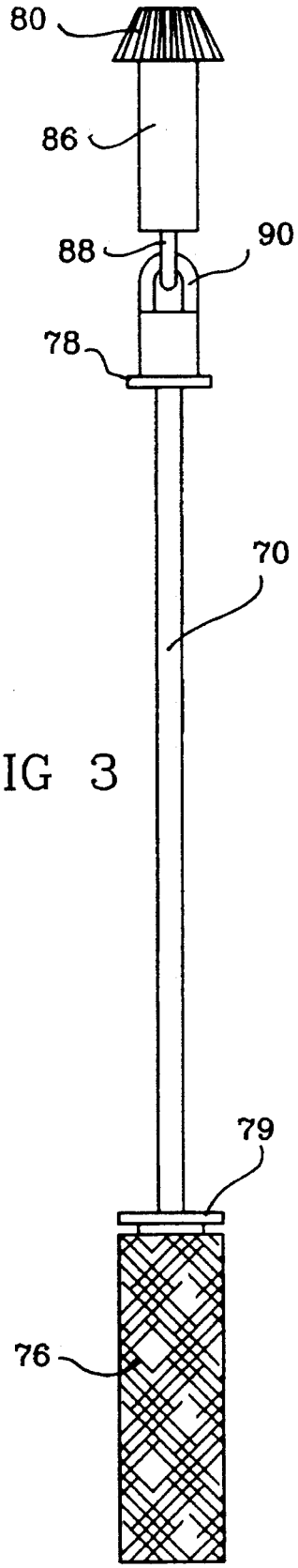
FIG. 3 is a side elevational view of the tilt rod drive means portion of the device.
Figure 4:
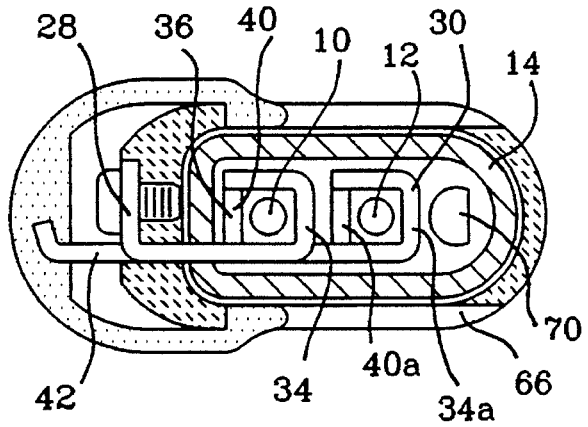
FIG. 4 is sectional view of the device.

The housing 14 further houses a tilt rod drive means, to permit a user to rotate the tilt rod. The tilt rod drive means comprises a shaft 70, seen in FIGS. 3 and 4, for rotation of the vanes. The shaft is journalled within upper and lower apertures 72 and 74 within the upper and lower caps 16 and 18, respectively, and extends outwardly from the housing through both apertures. A handle 76 is fitted to the lower end of the shaft, to allow a user to rotate the shaft. The shaft is provided with upper and lower shoulders 78 and 79 that each abut the lip of a corresponding aperture 72 and 74, to support the housing about the shaft. The shaft rotatably engages the gearing system of the headrail 2, seen in FIG. 2. The end cap 6 of the headrail encloses a rotary linkage to transmit rotary movement to the tilt rod. The rotary linkage comprises a bevel gear system comprising a drive gear 80 and a driven gear 82. The driven gear 82 has a horizontally-oriented axis and is engaged to the tilt rod 4. The drive gear 80 has a vertical axis and is engaged to a downwardly depending gearshaft 86. The gearshaft 86 terminates in a loop 88, that mates with a corresponding loop 90 extending upwardly from the end of the shaft 70. The loops allow the wand to pivot freely, in order to allow the user to angle the wand away from the blind to facilitate use. It will be seen that the shaft 70 and the gearshaft 86 may be linked by any type of universal joint.

It will be seen that the present device may be adapted for use with any type of blind that incorporates a headrail that partly houses a cord loop for the drawing open or closed of the blind. The device may be engaged to the headrail in a manner similar to that disclosed here. However, if the blind does not have rotatable vanes, it is not necessary to provide a tilt rod drive means within the device, since the cord loop is the only control member requiring actuation.

It will be further seen that the device may include an end cap for engagement to the headrail of an existing blind, with the endcap being adapted specifically for use with the blind. Alternatively, a supplier may supply a complete blind that incorporates the device.

The present invention has been described and illustrated by way of a preferred embodiment thereof. It will be seen by those skilled in the art that variations to the described embodiment may be made without departing from the spirit and scope of the invention, as defined by the appended claims.

I claim:

1. An integrated cord loop drive means and enclosure for enclosing and driving the cord loop of a window covering, said cord loop comprising first and second strands depending from said window covering, said drive means and enclosure comprising:

a) an elongate wand-shaped housing for enclosing said first and second strands, said housing having upper and lower portions and an axial slot extending generally the length of said housing through the wall of said housing;

b) a cord guide mounted at said lower portion of said housing, adapted to retain the lower end of said cord loop within said housing and to permit said cord loop to cycle through said housing; and c) a cord grip member engaged to said housing and slideably displaceable between said upper and lower portions, said cord grip member comprising first and second clamps disposed within said housing and first and second actuators external to said housing, each clamp being linked to a respective actuator through said axial slot, said first clamp being adapted to releasably grip said first strand when actuated by said first actuator and said second clamp adapted to releasably grip said second strand when actuated by said second actuator, said cord grip member adapted to permit a user to drive said cord loop through said housing in a first or second direction, when said first or second clamp is actuated, respectively.

2. An integrated cord loop drive means and enclosure as claimed in claim 1, wherein said cord grip member includes a generally tubular body slideably engaged about said housing, and said actuators each comprise a spring-biased member engaged to said body, wherein depression of either of said actuators actuates a corresponding clamp.

3. An integrated cord loop drive means and enclosure as claimed in claim 2, wherein said actuators each comprise a generally channel-shaped member partly wrapped about said body and linked thereto by means of a slidable engagement means.

4. An integrated cord loop drive means and enclosure as claimed in claim 1, wherein each of said clamps comprise a generally channel-shaped first jaw member and a second jaw member slideably disposed within the channel of said first jaw member, said jaw members adapted to releasably grip said first or second strand therebetween.

5. An integrated cord loop drive means and enclosure as claimed in claim 4, wherein said second jaw member is operatively linked to said actuator by an arm extending through said axial slot.

6. An integrated cord loop drive means and enclosure as claimed in claim 1 adapted for use with a vertical blind, said vertical blind having a tilt rod journalled within said headrail for rotation of the vanes thereof, said integrated cord loop drive means and enclosure being provided with tilt rod drive means to permit a user to rotate said tilt rod; said tilt rod drive means comprising: a shaft rotatably disposed within said housing and positioned axially therein; shaft rotation means to permit a user to rotate said shaft; and a link operatively connecting said shaft to said tilt rod.

7. An integrated cord loop drive means and enclosure as claimed in claim 6, wherein said shaft is provided with an end portion that depends downwardly from the lower end portion of said housing, and said shaft rotation means comprises a handle engaged to said end portion.

8. An integrated cord loop drive means and enclosure as claimed in claim 6, wherein said link includes a universal joint to pivotally link said shaft to said tilt rod.

9. An integrated cord loop drive means and enclosure as claimed in claim 8 wherein said universal joint comprises a pair of opposing linked loops.

10. A window covering comprising a headrail, a covering depending from said head rail, a covering closure means comprising a cord loop adapted to cycle through said headrail and actuate the opening or closure of said covering, said cord loop comprising first and second strands depending from said headrail and being driven by cord loop drive means comprising:

a) an elongate wand-shaped housing for enclosing said first and second strands and having upper and lower portions and an axial slot extending generally the length of said housing through the wall of said housing;

b) a cord guide mounted at said lower portion of said housing, adapted to retain the lower end of said cord loop within said housing and to permit said cord loop to cycle through said housing; and c) a cord grip member engaged to said housing and slideably displaceable between said upper and lower portions, said cord grip member comprising first and second clamps disposed within said housing and first and second actuators external to said housing, each clamp being linked to a respective actuator through said slot, said first clamp being adapted to releasably grip said first strand when actuated by said first actuator and said second clamp adapted to releasably grip said second strand when actuated by said second actuator, said cord grip member adapted to drive said cord loop through said housing in a first or second direction, when said first or second clamp is actuated, respectively.

11. A window covering as claimed in claim 10, wherein said cord grip member includes a generally tubular body slideably engaged about said housing, and said actuators each comprise a spring-biased member engaged to said body, wherein depression of said either of said actuators actuates a corresponding clamp.

12. A window covering as claimed in claim 11, wherein said actuators each comprise a generally channel-shaped member partly wrapped about said body and linked thereto by means of a slidable engagement means.

13. A window covering as claimed in claim 10, wherein each of said clamps comprise a generally channel-shaped first jaw member and a second jaw member slideably disposed within the channel of said first jaw member, said jaw members adapted to releasably grip said first or second strand therebetween.

14. A window covering as claimed in claim 13, wherein said second jaw member is operatively linked to said actuator by means of an arm extending through said axial slot.

15. A window covering as claimed in claim 10 comprising a vertical blind having vane rotation means, said vane rotation means including a tilt rod journalled within said headrail for rotation of the vanes thereof and tilt rod drive means housed within said cord loop drive means, said tilt rod drive means comprising: a shaft rotatably disposed within said housing and positioned axially therein; shaft rotation means to permit a user to rotate said shaft; and a linkage operatively connecting said shaft to said tilt rod.

16. A window covering as claimed in claim 15, wherein said shaft is provided with an end portion that depends downwardly from the lower end portion of said housing, and said shaft rotation means comprises a handle engaged to said end portion.

17. A window covering as claimed in claim 15, wherein said linkage includes a universal joint to pivotally link said shaft to said tilt rod.

* * * * *